United States Patent [19]

Andersson

[11] Patent Number: 4,534,248

[45] Date of Patent: Aug. 13, 1985

[54] METHOD AND AN APPARATUS FOR THE REMOVAL OF WASTE MATERIAL IN ROTARY PUNCHING

[75] Inventor: Thorbjörn Andersson, Södra Sandby, Sweden

[73] Assignee: Tetra Pak International AB, Lund, Sweden

[21] Appl. No.: 556,567

[22] Filed: Nov. 30, 1983

[30] Foreign Application Priority Data

Dec. 1, 1982 [SE] Sweden ..... 8206853

[51] Int. Cl.[3] ..... B26F 1/08

[52] U.S. Cl. ..... 83/24; 83/99; 83/100; 83/117; 83/152

[58] Field of Search ..... 83/116, 117, 23, 98–100, 83/152, 24

[56] References Cited

U.S. PATENT DOCUMENTS

| | | | |
|---|---|---|---|
| 687,905 | 12/1901 | Seymour | 83/117 |
| 1,372,949 | 3/1921 | Henneberry | 83/99 |
| 2,145,048 | 1/1939 | Hagen | 83/117 X |
| 2,302,855 | 11/1942 | Hallman | 83/117 |
| 2,393,745 | 1/1944 | Brunner | 83/116 |
| 2,525,987 | 10/1950 | Williamson | 83/117 |

*Primary Examiner*—James M. Meister

*Attorney, Agent, or Firm*—Burns, Doane, Swecker & Mathis

[57] ABSTRACT

In the rotary punching of a moving material web, the punched out waste material has to be removed so as not to interfere with the course of the punching. This can be done with a vacuum and internal ducts in the female roll, but this method cannot be used at high working speeds because of centrifugal force. Instead of this in accordance with the invention, the die hole of the female roll is provided with pistons that are maneuvered to and fro in rhythm with the rotation of the roll. As a result, the punching waste is retained for only a short while after the punching, and then is ejected and carried away via an external suction arrangement.

12 Claims, 5 Drawing Figures

METHOD AND AN APPARATUS FOR THE REMOVAL OF WASTE MATERIAL IN ROTARY PUNCHING

BACKGROUND AND SUMMARY OF THE INVENTION

The present invention relates to a method for the removal of waste material in punching units with co-operating rolls, one of which has a number of holes arranged to pick up the waste material punched out. The invention also relates to an apparatus for the realization of the method.

In the punching of a repeated pattern on a material web in general, rotary punching is applied making use of a male roll provided with projecting punches and a female roll provided with corresponding recesses. The material web may consist, e.g., of a laminated packing material which, with the help of a packing machine is to be gradually converted to packing containers of the non-returnable type for juice, milk or other beverages. In cases where it is intended for the beverage to be drunk directly from the packing container with the help of a suction tube, the material web is provided with suction tube holes in a predetermined pattern corresponding to the shape of the individual packing containers. The holes are provided by advancing the material web in the nip between the punching rolls so that suction tube holes are produced according to the desired pattern. Thus, the waste material is produced in the form of small punched-out discs which have to be collected so that they do not land on the ready-punched web or in some other undesirable place. Since the waste material discs are small and light it is very difficult, because of the high punching and feeding rates, to collect and remove them.

Up to now the waste material was usually removed via internal ducts in the female rolls. The recesses or holes in the roll surface were connected to an inner cavity in the roll, this cavity in turn being joined to a vacuum source so that the punching waste is sucked away from the punching region in the nip between the rolls. Owing to problems of seal-forming and noise, the vacuum has to be kept within certain limits. The method, therefore, has a natural limitation which makes it unsuitable for use at high punching speeds, since the rotation of the female roll causes an outwardly directed force which counteracts the vacuum and leads to the waste material sometimes sticking in the holes or even being blown on to the outside of the roll.

It is an object of the present invention to provide a method for overcoming the above problem.

It is a further object of the present invention to provide a reliable and simple method for the effective removal of waste material even when the rotary punching takes place at very high speeds.

These and other objects have been achieved in accordance with the invention with a method for the removal of waste material in a punching unit with co-operating rolls. One roll has a number of holes, each containing a piston arranged to pick up the waste material that has been punched out. The piston is moved during the rotation of the roll between an inner and an outer position so as to retain and then eject the waste material.

In accordance with the invention a strong vacuum is provided during a very short period in the holes which retain the punched out waste material, whereupon they are mechanically pushed out of the holes and sucked away. The event is synchronized with the rotation of the rolls and provides for very safe and rapid handling of the waste material.

It is a further object of the present invention to provide an apparatus for the realization of the method in accordance with the invention. This arrangement is capable of operating at great speed and reliability, and is not subject to the disadvantages of earlier arrangements.

It is a further object of the present invention to provide an apparatus for the removal of waste material in rotary punching. The apparatus has a simple and reliable design capable of being turned out at low cost.

These and other objects have been achieved in accordance with the invention with an apparatus of the type described in the introduction. Each hole comprises a piston which is axially movable in the hole. The piston is in substantially air-tight contact with the wall of the hole, and contacts manoeuvring elements for the displacement of the piston between different axial positions during rotation of the roll.

By placing the pistons directly adjoining the region where the vacuum, a maximum vacuum is achieved which safely retains the punching waste in the die hole. The simple design of the unit and the direct control of the axial movement of the piston by means of a cam track also guarantee an accurate synchronization between the movement of the piston and the rotation of the roll.

A preferred embodiment of the method as well as of the apparatus in accordance with the invention will now be described in more detail with special reference to the enclosed schematic drawings which only show the parts necessary for the understanding of the invention.

DETAILED DESCRIPTION OF THE PREFERRED EMBODIMENTS

Figure 1:
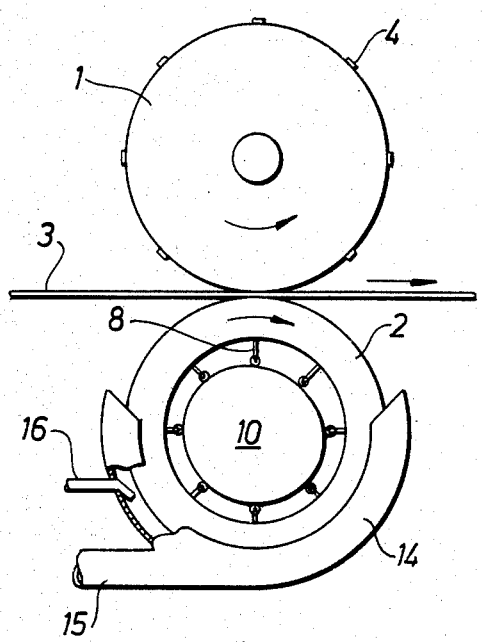
FIG. 1 is a side elevation of an arrangement in accordance with the invention as used in a rotary punching unit, a part of the arrangement having been removed for a clearer illustration of the invention.
Figure 2:
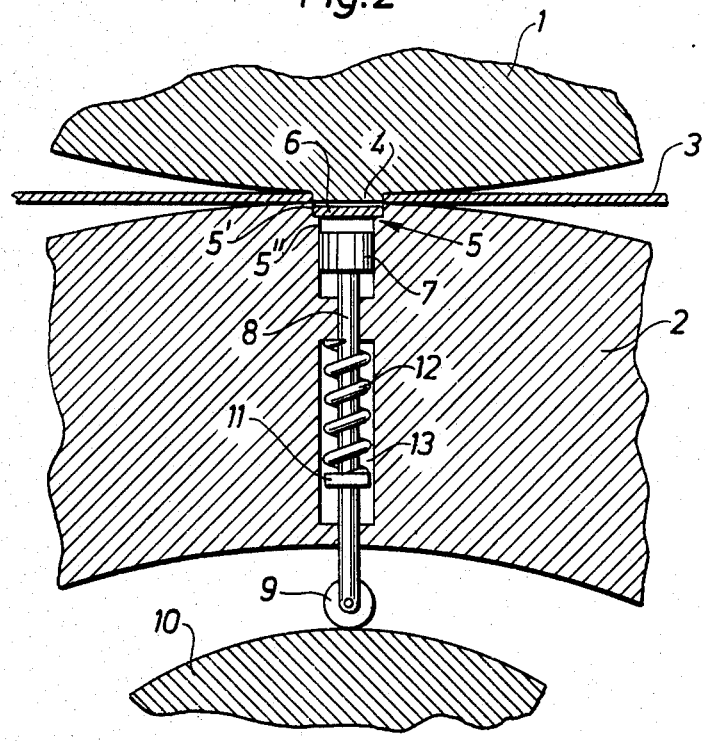
FIG. 2 shows on a larger scale a cross-section through the material web as well as the two punching rolls, the arrangement in accordance with the invention being clearly illustrated.

The arrangement in accordance with the invention shown in FIG. 1 comprises a punching unit with two punching rolls namely a male roll 1 and a female roll 2, which between them process a material web 3. The directions of movement of the material web 3 as well as of the two punching rolls 1,2 are indicated by means of arrows in FIG. 1. The two rolls 1,2 are supported in a stand, not shown, and are adjustable in a conventional manner in a direction towards or away from one another, so as to control the distance between the roll surfaces in the nip where the material web 3 is to pass. The male roll 1 is substantially cylindrical and comprises in conventional manner a number of punches 4 distributed in a regular pattern over the peripheral surface. The punches 4 project somewhat outside the peripheral surface of the male roll 1 in order to cooperate with corresponding holes 5 in the female roll 2, and the punching of the material web 3. The punches 4 for the rest are also conventionally designed, and their shape and attachment in the male roll 1 can be varied in different ways well known to those versed in the art. They are of no significance for the present invention and, therefore, do not have to be described in detail in this connection.

The female roll 2 is placed opposite the male roll 1 and parallel with the same. As mentioned earlier, rolls 2 has on its peripheral surface a number of holes 5 that co-operating with punches 4. The holes are distributed over the peripheral surface of the female roll 2 in a pattern corresponding to the distribution of the punches 4 in the roll 1. The holes 5 comprise an outer die part 5' and a cylinder wall 5''. The outer die part 5' of the hole 5 has a shape which corresponds to the shape of the punches 4 and a cross-sectional area which somewhat exceeds the corresponding cross-sectional area of the punches. As a result, the punching is made possible in a conventional manner in that the punches 4 penetrate slightly into the holes 5 while simultaneously punching out part of the material web 3. The punched out waste 6 will land in the die part 5' of the hole 5. There it rests against a steplike transition which exists between the different parts of the hole 5, since the die part 5' has a larger cross-sectional area than the cylinder wall 5''. The shape of the die part 5' may be varied within wide limits depending upon the desired form of the punching. The cylinder wall 5'' is preferably cylindrical and has a cross-sectional area which substantially corresponds to the cross-sectional area of a piston 7 which has a sliding fit in the cylinder wall 5'' of the hole 5. The piston 7 is axially movable in the hole 5 and is moved during the rotation of the roll 2 between different axial positions. The piston 7 forms an air-tight seal with the wall of the hole 5 within the region of the hole which serves as a cylinder wall 5''. When the material web 3 is to be provided with holes whose size and diameter correspond to the diameter of the piston 7, the cylinder wall 5'' will also serve on its front end as a die part 5'. The punching waste 6 punched out frequently is of an irregular shape and has a size greater than the piston 7, which makes it necessary to provide die part 5' with a larger area than the cylinder wall 5''. The die part 5' with the surrounding material region, may also be in the form of an exchangeable die which in conventional manner is placed in a corresponding recess in the roll surface. Thus it can be simply substituted in case of wear or alteration of the size and shape of the punched hole.

At the back of the piston 7 there is a piston rod 8 which extends radially through the female roll so as to run on its inner end facing towards the center axis of the roll 2 via a roller 9 on a stationary cam track 10. Between the piston 7 and the roller 9 the piston rod 8 is provided with a flange 11 against which a helical spring 12 rests with one of its ends. The spring 12 is enclosed in a spring chamber 13 in the female roll 2 and rests with its other end against an end of the spring chamber 13. The spring 12 has a compression spring and will act owing to its placing between the flange 11 and the end wall of the spring chamber 13, on the piston rod 8. Consequently, the piston 7 will move in a direction axially inwards against the centre axis of the female roll 2, so that the roller 9 will be constantly pressed against the cam track 10.

FIG. 1 also shows how the lower part of the female roll 2 is surrounded by a suction casing 14 which is connected via connecting duct 15 to a vacuum source, not shown, and a collecting chamber for punching waste. Suction casing 14 contains one or more blow nozzles 16 which are directed substantially tangentially to the peripheral surface of the female roll 2 seen in the direction of movement of the roll. During operation of the arrangement in accordance with the invention the two rolls 1,2 are rotated in opposite directions with the help of drive units, not shown. The material web 3 is fed between the rolls with simultaneous punching out of selected parts. The material web 3 may be a web of laminated material intended for used in the manufacture of non-returnable packages. The finished packing containers are to be provided with emptying openings or holes for suction pipes. With the help of the apparatus, holes are punched according to a predetermined pattern which corresponds to the pattern of the packing container blanks on the material web. During the punching out, punching waste 6 is produced in the form of small, circular or oval bits of material web which, owing to their smallness and lightness, tend to whirl about and make working difficult.

Figure 3:
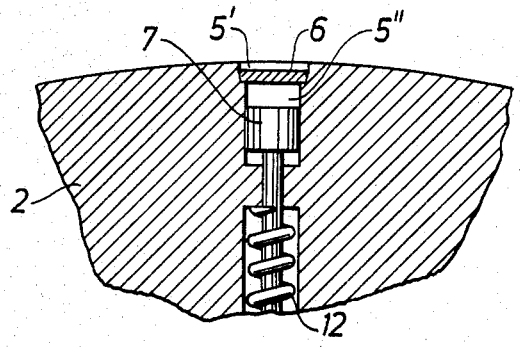
FIGS. 3, 4 and 5 shows on an enlarged scale a section through the female roll, the stepwise operation of the method according to the invention being illustrated schematically.
Figure 4:
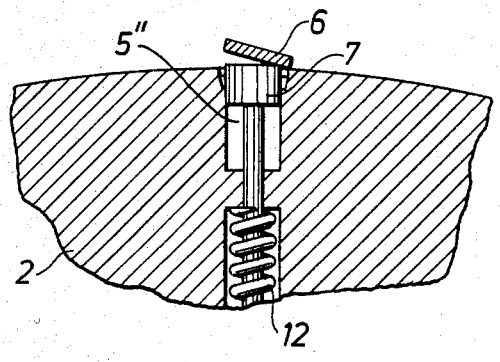
Figure 5:
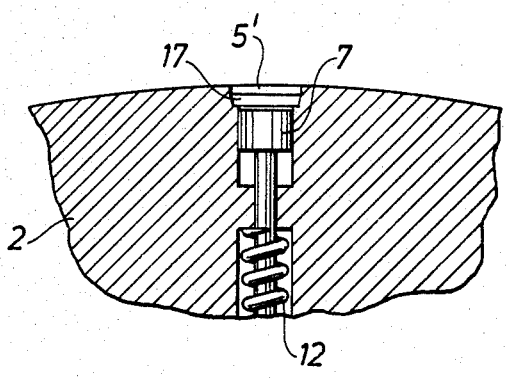

When punching a hole into the material web 3 a projecting punch 4 on the male 1 is co-operating in conventional manner with corresponding holes 5 in the female roll 2. The punching waste 6 punched out is pushed down by the punch 4 into the outer end of the hole 5 which, in accordance with the invention, may be designed as a die part 5'. The die part 5', as mentioned earlier, has a contour and shape which correspond to the desired shape of the hole which is to be punched into the material web 3. Therefore, by its peripheral edge, the punching waste 6 will be substantially in contact with the limiting wall of the die part 5'. The punching waste 6 is pushed until the underside rests against the steplike transition between the die part 5' of the hole 5 and the cylinder wall 5'' of the hole which has a smaller cross-sectional area than the die part 5' (FIG. 3). The piston 71 which is axially movable in the hole 5, is moved periodically to and fro during the rotation of the female roll 2 between substantially three axial positions: an inner position (FIG. 3), an outer position (FIG. 4) and an intermediate position (FIG. 5). This movement takes place against the force of the spring 12 which presses the roller 9 against the cam track 10 so that during the rotation of the female roll 2 the said cam track 10 periodically moves the piston 7 between the different axial positions. The cam track 10 is designed so that the piston 7, which at a given instant is closest to the material web 3, is displaced axially inwards from the intermediate position to the inner position at the same time as the punching out of the punching waste 6 in the form of a material disc. On punching, as mentioned earlier, the punching waste 6 is pushed down into the die part 5' of the hole 5 where it forms a seal against the steplike shoulder between the die part 5 and the cylinder wall 5''. The simultaneous movement downwards of the piston 7, owing to the piston forming an air-tight seal against the wall 5', causes a vacuum in the space above the piston 7, that is to say the space in the hole 5 situated between the top of the piston 7 and the punching waste 6. The vacuum is maintained and is successively increased owing to the cam surface of the cam track 10 during approximately a $\frac{1}{4}$ turn of the female roll 2. The piston is thus moved successively closer to its inner position at the same time it is moved by the female roll 2 from a horizontal position vertically upwards to a position straight to the right shown in FIG. 1. During this quarter of the rotation of the female roll, the punching waste 6, because of the increasing vacuum in the hole 5, will thus be retained by the surrounding air pressure in the die part 5' of the hole 5. By placing the piston 7 directly below the punching waste 6 a direct and strong vacuum is provided. Moreover, successively increasing the vacuum to retains the waste even if there is a certain amount of leakage between the punching waste 6 and the hole 5.

When the piston 7, because of the rotation of the female roll 2, reaches a horizontal position to the right in FIG. 1, the periphery of the female roll is surrounded by a suction casing 14 and the punching waste 6 is ejected from the hole 5 to be sucked away via the suction casing 14 and the connecting duct 15. To ensure the ejection of the punching waste 6, the piston is moved successively from its inner to its outer position as the cam surface of the cam track 10 withdraws successively from the centre axis of the female roll 2. This produces a reduction of the vacuum in the hole 5. Then the top of the piston 7 comes to rest against the underside of the punching waste and mechanically pushes the punching waste 6 out of the hole. The top of the piston 7, in the outer position of the piston, will be substantially level with, or slightly outside, the peripheral surface of the roll 2. To ensure that the punching waste 6 leaves hole 5 even if, for example, the punching waste has a sticky or pasty surface, the suction casing 14 is provided with a blow nozzle 16 which by means of an orifice directed tangentially to the peripheral surface of the roll to ensure that an air jet flowing against the direction of rotation of the roll reliably removes the punching waste 6 and blows it in the direction of the connecting duct 15 of the suction casing 14.

After the punching waste 6 has been removed from the hole 5, the piston, during continued rotation of the roll 2 from a position substantially horizontally (to the left in FIG. 1) to a vertical position close to the material web 3, is displaced from its outer position to an intermediate position. As with the earlier axial position movements, the piston displacement takes place with the help of the cam track 10, whose cam surface during a quarter turn once more approaches the centre axis of the female roll 2. Piston rod 8 is moved by spring 12 toward the center axis and conveys the piston 7 to an intermediate position. In the said intermediate position, the top of the piston 7 is substantially level with, or slightly below, the steplike transition between the die part 5' and the cylinder wall 5''. During the subsequent punching operation the punching waste 6 can be pressed again into the hole 5 and the described cycle is repeated again.

As mentioned earlier, hole 5 comprises two parts separated by means of a steplike shoulder, namely defining outer die part 5', whose cross-sectional area substantially corresponds to the cross-sectional area of the punch 4, and the inner cylinder wall 5'' which is cylindrical and has a diameter that substantially corresponds to the diameter of piston 7. Of course, the different hole parts 5' and 5'' may be varied independently of each other as to shape and size. If circular holes are to be punched in the material web 3, it is also possible to give the die part 5' and the cylinder wall 5'' the same shape and size. The steplike shoulder can then be eliminated or replaced by a flange arranged at an appropriate level in hole 5. To ensure further the formation of a tight seal between the punching waste 6 and the walls of the hole 5, die part 5' can be provided, on its inner end part facing the steplike shoulder, a conical portion 17, whose inner end has a diameter is slightly less than the diameter of the punching waste 6. Such a design is shown in FIG. 5. Such a design is particularly suitable for punching fibrous material, since the edges of the punching waste often obtain a somewhat irregular and elastic contour. The conical portion 17 here further enhances the sealing effect, and it has been found in practice that in the punching of mostly laminated plastic-coated material a fully satisfactory seal is obtained between the steplike shoulder and the underside of the punching waste 6. In many cases it has been found that on punching cylindrical punching waste an adequate seal is obtained simply through contact between the peripheral edge of the punching waste and the cylindrical surface of the hole 5. Thus the steplike shoulder can be dispensed with, making the manufacture of the female roll considerably less expensive. The detailed design of the hole 5, and especially that of its front end serving as a die part may vary within wide limits and be adapted to the different types of punches and material tubes which are to be processed. The adapting may be facilitated further by designing the punch dies as exchangeable wearing parts in the peripheral surface of the roll which makes it possible to use the same roll for a number of different ranges of application.

The shape of the piston 7 may also be modified in different ways, and it is also possible to provide the piston with appropriate sealing elements, e.g., rubber gaskets or rubber sleeves. The sealing element may also be wholly or partly in the form of a membrane enclosing the piston or the piston rod which, on its outer rim, forms a seal with the hole wall. The term "piston" thus includes different types of membranes or other designs functioning in a corresponding manner. However, such modification need not be described here in detail.

The apparatus in accordance with the invention has proven in practical trials to work well and considerable safety in the handling of punching waste has been achieved. Handling no longer constitutes the speed-limiting factor which previously created an upper limit to possible punching speeds.

The principles, preferred embodiments and modes of operation of the present invention have been described in the foregoing specification. The invention which is intended to be protected herein should not, however, be constructed as limited to the particlular forms described, as these are to be regarded as illustrative rather than restrictive. Variations and changes may be made by those skilled in the art without departing from the spirit of the present invention. Accordingly, the foregoing detailed description should be considered as exemplary in nature and not limiting to the scope and spirit of the invention as set forth in the appended claims.

What is claimed is:

1. A method for the removal of waste material in punching units with cooperating rolls comprising the steps of: providing a number of holes in one of the rolls for receiving punched out waste material, locating a piston in each hole moveable between an inner retracted position, an intermediate position, and an outer extended position, providing an airtight relationship between each piston and walls of each associated hole, creating a vacuum in a hole at the same time waste material is received by retracting the piston, and ejecting the waste material by extending the piston when the roll has been rotated so as to place the hole having the waste material at an ejecting station.

2. A method in accordance with claim 1 comprising situating a top portion of the piston in the outer position at a position substantially level with the surface area of the roll.

3. A method in accordance with claim 2 comprising situating the piston, in the inner position, at such a distance from a peripheral surface of the roll that the punched out waste material can be pushed by the punch down into the hole.

4. A method in accordance with claim 2, comprising situating the top portion of the piston in the intermediate position so that it is level with a transition between a die part, the hole and a cylinder wall.

5. a method in accordance with claim 4, and further including the step of pushing the waste material by the punch down into the hole to rest against a step-like transition between the die part and the cylinder wall of the hole.

6. An apparatus for the removal of waste materials in punching units comprising a first roll with plural punches mounted thereon, a second roll with plural holes mounted to cooperate with the punches and to receive waste material punched out by the punches, means for creating a vacuum in each hole for retaining said waste comprising a piston mounted in each hole in airtight engagement with walls of each associated hole, said piston being moveable between an inner retracted position, an intermediate position, and an outer extended position so that when the piston is retracted a vacuum is created to retain waste material in the hole and when the the piston is extended waste material is ejected from the hole.

7. An apparatus in accordance with claim 6 wherein the piston is maneuverable by means of a cam arrangement situated in the interior of said at least one of said cooperating rolls and comprises a stationary cam track, which via intermediate elements acts on the piston in an axial direction.

8. An apparatus in accordance with claim 6 wherein the piston is acted on by means of a spring device in the direction of the center axis of the roll.

9. An apparatus in accordance with claim 6 wherein the cross-sectional areas of the hole and the piston are of substantially equal size, the piston having a sliding fit in the hole.

10. An arrangement in accordance with claim 6, wherein a die part of the hole situated closest to the roll surface has a greater cross-sectional area than the cylinder wall of the hole, the said greater cross-sectional area corresponding substantially to the cross-sectional area of the co-operating punch.

11. An apparatus in accordance with claim 10, wherein the transition between the different cross-sectional areas in the hole occurs in a step-like manner.

12. An apparatus in accordance claim 6, wherein suction devices are arranged along a peripheral part of the at least one of said co-operating rolls.

* * * * *